US008693908B2

(12) United States Patent
Nishiyama et al.

(10) Patent No.: US 8,693,908 B2
(45) Date of Patent: Apr. 8, 2014

(54) IMAGE FORMING APPARATUS AND IMAGE FORMING METHOD

(75) Inventors: Kazuhiro Nishiyama, Shiojiri (JP); Akihiro Gomi, Fujimi-machi (JP); Tsutomu Sasaki, Matsumoto (JP); Naotaka Higuchi, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 261 days.

(21) Appl. No.: 13/351,787

(22) Filed: Jan. 17, 2012

(65) Prior Publication Data

US 2012/0201555 A1 Aug. 9, 2012

(30) Foreign Application Priority Data

Feb. 3, 2011 (JP) ..... 2011-021456

(51) Int. Cl.
*G03G 15/10* (2006.01)

(52) U.S. Cl.
USPC ..... 399/57; 399/237; 399/240

(58) Field of Classification Search
USPC ..... 399/55, 57, 58, 233, 237, 240
See application file for complete search history.

(56) References Cited

U.S. PATENT DOCUMENTS

| | | | | |
|---|---|---|---|---|
| 6,203,961 | B1 * | 3/2001 | Pan et al. | 430/114 |
| 7,778,576 | B2 | 8/2010 | Tanjo et al. | 399/238 |
| 2009/0110423 | A1 * | 4/2009 | Tanaka | 399/57 |
| 2009/0110424 | A1 * | 4/2009 | Tanaka et al. | 399/57 |
| 2009/0245833 | A1 * | 10/2009 | Sasaki et al. | 399/60 |
| 2010/0226687 | A1 * | 9/2010 | Fukazawa | 399/240 |

FOREIGN PATENT DOCUMENTS

| | | |
|---|---|---|
| JP | 2000-330385 | 11/2000 |
| JP | 2000330385 A | 11/2000 |
| JP | 2009-075552 | 4/2009 |

* cited by examiner

*Primary Examiner* — Walter L Lindsay, Jr.
*Assistant Examiner* — Rodney Bonnette
(74) *Attorney, Agent, or Firm* — DLA Piper LLP (US)

(57) ABSTRACT

An image forming apparatus of the invention includes; a cleaning member that collects liquid developer by cleaning a developer carrier; a first transporting path that moves the liquid developer collected by the cleaning member; an oscillating member that applies vibration to the liquid developer transported from the first transporting path; a developer supply unit that stores the liquid developer transported from a first transporting mechanism; a second transporting mechanism that includes a second transporting path that transports the liquid developer stored in the developer supply unit to a developer storage in a developing unit; and a control unit that adjusts a toner charge current applied to the toner charging unit and controls vibration applied to the oscillating member on the basis of the adjusted toner charge current.

8 Claims, 13 Drawing Sheets

OPERATION RATE: 60%

OPERATION RATE: 80%

FIG. 12

| TONER CHARGE CURRENT [μA] | DEVELOPER SUPPLY AMOUNT [g/min] | DEVELOPMENT AMOUNT [g/min] | DEVELOPING BLADE COLLECTION AMOUNT [g/min] | OVERFLOW AMOUNT [g/min] | SQUEEZE BLADE [g/min] | DISPERSION CONTAINER STORAGE AMOUNT [g] |
|---|---|---|---|---|---|---|
| 20 | 200 | 12 | 18 | 170 | 9 | 197 |
| 40 | 150 | 12 | 18 | 120 | 9 | 147 |
| 60 | 100 | 12 | 18 | 70 | 9 | 97 |

IMAGE FORMING APPARATUS AND IMAGE FORMING METHOD

BACKGROUND

1. Technical Field

The present invention relates to an image forming apparatus and an image forming method that form an image by developing a latent image formed on a photoreceptor with a liquid developer, such as toner or carriers, and transferring the developed image onto a recording material.

2. Related Art

Various wet type image forming apparatuses that develop a latent image, using a high-viscosity liquid developer formed by dispersing toner made of solid components into a liquid solvent, and visualize an electrostatic latent image have been proposed. The developer used in the wet type image forming apparatuses is made by suspending solid content (toner particles) into a high-viscosity organic solvent (carrier liquid) having electric insulation, which is made of silicon oil, mineral oil, or food oil, in which the diameter of the toner particles is very small, around 1 μm. It is possible in the wet type image forming apparatuses to achieve high quality in comparison to dry type image forming apparatuses using a powder type of toner particles with particle diameter of about 7 μm, by using fine toner particles.

In the image forming apparatuses using the liquid developer, it has been attempted to efficiently use the liquid developer in various ways by reusing the liquid developer that has not contributed to visualizing the electrostatic latent image.

An image forming apparatus that circulates a liquid developer by supplying the liquid developer to a supply unit in a developer container from a developer collecting-replenishing unit, collecting the liquid developer overflowing the supply unit through a partition into a collecting unit, and returning the collected liquid developer to the developer collecting-replenishing unit is disclosed in JP-A-2009-75552.

An image forming apparatus equipped with an ultrasonic vibrator provided with at least one of a developing tank, a liquid toner tank, a liquid toner supply unit, and a liquid toner collecting unit is disclosed in JP-A-2000-330385. It is possible to prevent waste of toner and deterioration of the quality of a developed image due to toner aggregation substances by dispersing even toner particles, which can be reused in developing, even if toner aggregation substances are produced in a liquid developer, by applying ultrasonic vibration to the liquid developer from the ultrasonic vibrator.

It is disclosed in JP-A-2000-330385 that it is possible to prevent aggregation of liquid toner by disposing an ultrasonic vibrator in a circulation system of liquid toner, but the ultrasonic vibrator is just uniformly driven in the liquid developing device. The state of the liquid toner (liquid developer) is changed by various process conditions in image forming and it is difficult to cope with the state of the liquid developer when the ultrasonic vibrator is uniformly driven.

Further, when ultrasonic vibration is applied to the liquid developer, the liquid developer increases in temperature and correspondingly changes in viscosity. When excessive ultrasonic vibration is applied in consideration of the worst aggregation of the liquid developer, the temperature excessively increases, viscosity correspondingly changes, and the formed image is deteriorated.

SUMMARY

An advantage of some aspects of the invention is to form an image with high quality by stably dispersing a liquid developer without excessive increase in temperature, by applying appropriate ultrasonic vibration to the liquid developer, in consideration of the state of the liquid developer.

According to an aspect of the invention, there is provided an image forming apparatus including: a developing unit including a liquid developer storage that stores a liquid developer containing toner and carrier liquid, a developer carrier that carries the liquid developer, a toner charging unit that charges the liquid developer receiving a toner charge current and carried on the developer carrier, and a cleaning member that collects the liquid developer by cleansing the developer carrier; a first transporting mechanism including a first transporting path through which the liquid developer collected by the cleaning is moved member and an oscillating member that is disposed in the first transporting path and applies vibration to the liquid developer to be transported to the first transporting path, in order to transport the liquid developer; a developer supply unit storing the liquid developer transported from the first transporting mechanism; a second transporting mechanism including a second transporting path that transports the liquid developer stored in the developer supply unit to the developer storage of the developing unit; and a control unit adjusting the toner charge current that is applied to the toner charging unit and controlling vibration of the oscillating member on the basis of the adjusted toner charge current.

In the image forming apparatus, the toner charging unit may be a corotron charging unit having a wire and a shield and the toner charge current may be a difference between a current flowing to the wire and a current flowing to the shield.

In the image forming apparatus, the control unit may make the oscillating member oscillate with a first bias when the toner charge current applied to the toner charging unit is a first current value, and may make the oscillating member oscillate with a second bias larger than the first bias when the toner charge current applied to the toner charging unit is the second current value larger than the first current value.

In the image forming apparatus, the control unit may change power supplied the oscillating member from first power to second power, after a predetermined time has passed, when the toner charge current applied to the toner charging unit is changed from the first current value to the second current value.

In the image forming apparatus, the control unit may control the amount of the liquid developer transported to the second transporting mechanism on the basis of the toner charge current applied to the toner charging unit.

In the image forming apparatus, the control unit may allow the liquid developer transported from the second transporting mechanism to be transported at a first transport amount when the toner charge current applied to the toner charging unit is the first current value, and may allow the liquid developer transported from the second transporting mechanism to be transported at a second transport amount smaller than the first transport amount when the toner charge current applied to the toner charging unit is the second current value.

In the image forming apparatus, the oscillating member may be an ultrasonic vibrator.

According to another aspect of the invention, there is provided an image forming method including: carrying a liquid developer containing toner and carrier liquid, which is stored in a developer storage disposed in a developing unit, to a developer carrier; charging the liquid developer carried on the developer carrier with a toner charging unit; developing a latent image formed on a latent image carrier with the liquid developer charged by the toner charging unit; cleaning the developer carrier used for developing the latent image with a cleaning member; applying vibration with power, which is adjusted on the basis of toner charge current applied to the toner charging unit, to the liquid developer collected by the cleaning member by using an oscillating member disposed in a first transporting path, and transporting the liquid developer from the first transporting path to the developer supply unit; and transporting the liquid developer stored in the developer supply unit to the developer storage of the developing unit from a second transporting path.

According to the image forming apparatus and the image forming method of the invention, since the vibration applied to the oscillating member is controlled in accordance with the toner charge current flowing to the toner charging unit, it is possible to effectively prevent aggregation of the toner while suppressing an increase in temperature of the liquid developer, and accordingly, it is possible to provide an image with high quality. Further, it is also possible to suppress power consumption by applying the vibration in accordance with the state of the collected liquid.

Further, since the transport amount of the liquid developer in the second transporting mechanism is controlled on the basis of the toner charge current flowing to the toner charging unit, it is possible to adjust the amount of collected liquid in the first transporting mechanism and effectively apply vibration to the collected liquid from the oscillating member.

Further, when the toner charge current flowing to the toner charging unit is changed, it is possible to apply vibration to the collected liquid at an appropriate timing in consideration of the transporting time of the collected liquid, by changing the vibration applied from the oscillating member after a predetermined time has passed.

Further, when the toner charge current flowing to the toner charging unit is changed, it is possible to charge an appropriate amount of collected liquid in the second transporting path and more effectively distribute the collected liquid, by changing the transport amount of the liquid developer in the second transporting mechanism, after a predetermined time has passed.

BRIEF DESCRIPTION OF THE DRAWINGS

The invention will be described with reference to the accompanying drawings, wherein like numbers reference like elements.

FIG. 12 is a view showing the amount of a developer at each unit according to another embodiment.

DESCRIPTION OF EXEMPLARY EMBODIMENTS

Figure 1:
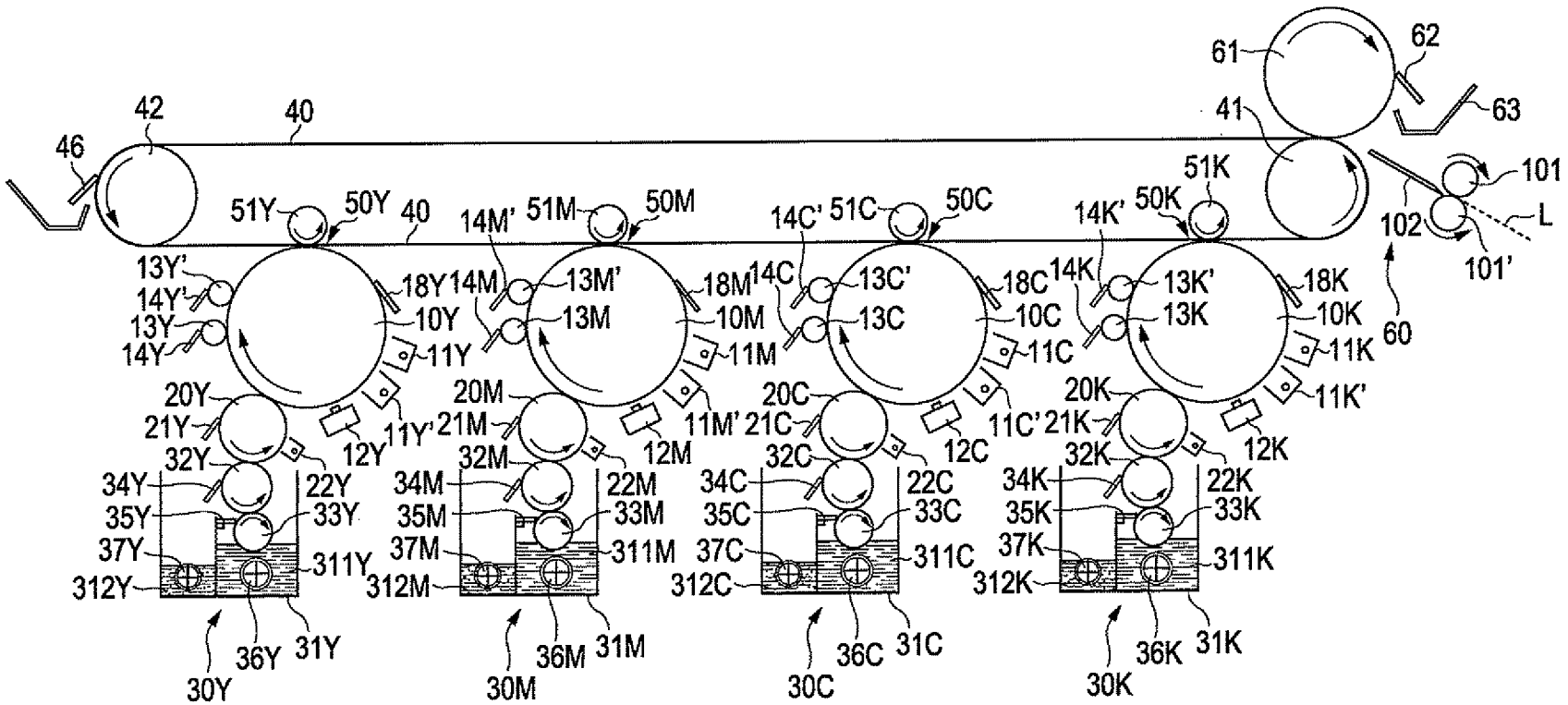
FIG. 1 is a view showing the main configuration of an image forming apparatus.

Hereinafter, embodiments of the invention will be described with reference to the drawings. FIG. 1 is a view showing the main configuration of an image forming apparatus according to an embodiment of the invention. An image forming apparatus according to the embodiment includes four image forming units each having a transferring belt 40, and photoreceptors 10Y, 10M, 10C, and 10K, as a main configuration, four developing devices 30Y, 30M, 30C, and 30K disposed to correspond to the photoreceptors 10Y, 10M, 10C, and 10K (latent image carriers in the invention), a secondary transferring unit disposed at the right of the transferring belt 40 in the figure, and a cleaning unit disposed at the left of the transferring belt 40 in the figure.

Hereinafter, the image forming units and the developing devices 30Y, 30M, 30C, and 30K for each color have the same configuration, such that the description is based on an image forming unit and a developing device for yellow (Y).

The developing unit 30Y is a device that develops a latent image formed on a photoreceptor 20Y by a liquid developer, and includes a developing roller 10Y, an intermediate roller 32Y, an anilox roller 33Y, a liquid developer container 31 storing the liquid developer, and a toner charging unit 22Y that charges the toner on the developing roller 20Y, which are main components.

A cleaning blade 21Y, the intermediate roller 32Y, and the toner charging unit 22Y are disposed on the outer circumference of the developing roller 20Y. The surface of the intermediate roller 32Y is in contact with the developing roller 20Y and a supply roller 33Y and an intermediate roller cleaning blade 34Y is disposed on the outer circumference.

A regulator 35Y that adjusts the amount of the liquid developer drawn from a developer storage 311Y is in contact with the anilox roller 33Y. Further, in the triple-roller type using the intermediate roller 32Y, as in the image forming apparatus of the embodiment, it is possible to adjust the amount of the liquid developer by the intermediate roller 32Y being in contact with the supply roller 33Y, such that it may be possible to remove the regulator 35Y.

The liquid developer received in the developer container 31Y is not a volatile liquid developer containing Isopar (Trade mark: Exxon) as a carrier and having low concentration (about 1 to 2 wt %), low viscosity, and volatility at room temperature, but a non-volatile liquid developer having high concentration, high viscosity, and non-volatility at room temperature. That is, the developer of the invention is a high-viscosity liquid developer (with viscoelasticity of about 30 to 300 mPa·s at shear velocity of 1000 (1/s) at 25° C., using HAAKERheoStressRS600) produced by adding solids having the average particle diameter of 1 μm by dispersing a colorant, such as a pigment into thermoplastic resin, into a liquid solvent, such as an organic solvent, silicon oil, mineral oil, or food oil, together with a dispersant to have toner solid content concentration of about 25%.

The anilox roller 33Y functions as an applying roller that performs application by supplying the liquid developer to the intermediate roller 32Y. The anilox roller 33Y is a roller that a cylindrical member and has a concave-convex surface with fine and uniform spiral grooves on the surface to carry the developer on the surface. The liquid developer is supplied from the developing container 31Y to the developing roller 20Y by the anilox roller 33Y. When the apparatus operates, as shown in the figure, the supply roller 33Y applies the liquid developer onto the intermediate roller 32Y while rotating clockwise.

The regulator 35Y is a metal blade with a thickness of about 200 μm and adjusts the amount of liquid developer that is supplied to the developing roller 20Y by regulating the thickness and amount of the liquid developer carried and transported by the anilox roller 33Y, in contact with the surface of the anilox roller 33Y.

The intermediate roller 32Y is a cylindrical member, and, as shown in the figure, is in counter-contact with the developing roller 20Y while rotating counterclockwise about the rotational center, similar to the developing roller 20Y. The intermediate roller 32Y is formed by disposing an elastic layer on a metallic core, similar to the developing roller 20Y.

An intermediate roller cleaning blade 34Y is disposed downstream from the contact position of the intermediate roller 32Y and the developing roller 20Y, in contact with the intermediate roller 32Y, such that the liquid developer that is not supplied to the developing roller 20Y is scraped and collected into a collected-liquid storage 312Y in the developer container 31Y.

The developing roller 20Y is a cylindrical member and rotates counterclockwise about a rotational center, as shown in the figure. The developing roller 20Y is formed by disposing an elastic layer, such as polyurethane rubber, silicon rubber, NBR, or PFA tube, on the outer circumference of a core made of metal, such as iron.

A developing roller cleaning blade 21Y ("cleaning member" in the invention) is implemented by rubber or the like which is in contact with the surface of the developing roller 20Y and scrapes and removes the liquid developer remaining on the developing roller 20Y because the developing roller is positioned downstream in the rotational direction of the developing roller 20Y further than a development-nipping portion being in contact with the photoreceptor 10Y. The developer remaining after development is scraped and removed by the developing roller cleaning blade 21Y and dropped into the collected-liquid storage 312Y in the developer container 31Y for reuse.

The toner charging unit 22Y is a unit that adjusts the charging state of the liquid developer applied on the surface of the developing roller 20Y and a corotron charging unit without a grid electrode on a discharge side is used in the embodiment. The liquid developer transported by the developing roller 20Y is charged by an electric field applied by corona discharge at a position close to the toner charging unit 22Y.

The image forming unit is composed of two corona charging unit 11Y and 11Y', an exposing unit 12Y, a photoreceptor squeeze device, a primary transferring unit 50Y, and a photoreceptor cleaning blade 18Y, which are sequentially disposed in the rotational direction of the outer circumference of the photoreceptor 10Y. The image forming unit is in contact with the developing roller 20Y of the developing unit 30Y, on the outer circumference of the photoreceptor 10Y, between the exposing unit 12Y and a first squeeze roller 13Y.

The photoreceptor 10Y is a photoreceptive drum, which is a cylindrical member with a photosensitive layer, such as an amorphous silicon photoreceptor, on the outer circumference, and rotates clockwise.

Two corona charging units 11Y and 11Y' are disposed downstream further than the nipping portion of the photoreceptor 10Y and the developing roller 20Y in the rotational direction of the photoreceptor 10Y, and corona-charge the photoreceptor 10Y by receiving a voltage from a power supply unit (not shown). The photosensitive unit 12Y forms a latent image on the photoreceptor 10Y by radiating light onto the photoreceptor 10Y charged by the corona charging units 11Y and 11Y', downstream further than the corona charging unit 11Y in the rotational direction of the photoreceptor 10Y.

The photoreceptor squeeze device disposed upstream further than the primary transferring unit 50Y is positioned at the downstream side of the developing roller 20Y, opposite to the photoreceptor 10Y. The photoreceptor squeeze device includes the first photoreceptor squeeze roller 13Y, which is an elastic roller rotating in contact with the photoreceptor 10Y, a second photoreceptor squeeze roller 13Y', and photoreceptor squeeze roller cleaning blades 14Y and 14Y', and has a function of increasing the ratio of toner particles in a microscope image (toner image) by collecting remaining carrier liquid from the toner image developed on the photoreceptor 10Y and fog toner that was originally unnecessary. Further, a bias voltage for introducing the fog toner to the photoreceptor squeeze rollers 13Y and 13Y' is applied to the photoreceptor squeeze rollers 13Y and 13Y'.

The photoreceptor squeeze roller cleaning blades 14Y and 14Y' are disposed in contact with the photoreceptor squeeze rollers 13Y and 13Y', respectively, and scrape the liquid developer containing the collected carrier liquid or for toner to be dropped into the collected-liquid storage 312Y in the developer container 31Y.

The surface of the photoreceptor 10Y passing through the squeeze device composed of the first photoreceptor squeeze roller 13Y and the second photoreceptor squeeze roller 13Y' enters the primary transferring unit 50Y. In the primary transferring unit 50Y, the developer image developed on the photoreceptor 10Y is transferred onto the transferring belt 40 by a primary transferring backup roller 51Y. In the primary transferring unit 50Y, the toner image on the photoreceptor 10Y is transferred onto the transferring belt 40 by transferring bias applied to the primary transferring backup roller 51Y. The photoreceptor 10Y and the transferring belt 40 move at a constant speed, such that driving load due to rotation and movement is reduced and disturbance on the microscope toner image of the photoreceptor 10Y is suppressed.

The photoreceptor cleansing blade 18Y in contact with the photoreceptor 10Y cleans the carrier-rich liquid developer on the photoreceptor 10Y, at the downstream side of the primary transferring unit 50Y.

The transferring belt 40 (transferring member) has a three-layered structure in which an elastic intermediate layer is disposed on a polyimide base layer and a PFA surface layer is disposed thereon. The transferring belt 40 is held on a belt driving roller 41 and a tension roller 42 and used such that the toner image is transferred onto the PFA surface layer. In the image forming apparatus of the embodiment, although the transferring belt 40 is used as a member for transferring, it is not limited to the belt and various transferring members, such as a roller and a drum, may be employed.

In the primary transferring units 50Y, 50M, 50C, and 50K in which the photoreceptors 10Y, 10M, 10C, and 10K and the primary transferring backup rollers 51Y, 51M, 51C, and 51K are disposed opposite each other with the transferring belt 40 therebetween, a full-colored toner image is formed on the transferring belt 40 by sequentially transferring the toner images of the colors of the developed photoreceptors 10Y, 10M, 10C, and 10K on the transferring belt 40 to overlap each other, with the contact positions with the photoreceptors 10Y, 10M, 10C, and 10K as transferring positions.

In a secondary transferring unit 60, a secondary transferring roller 61 is disposed opposite a belt driving roller 41 with the transferring belt 40 therebetween, whereby a secondary transferring unit (nipping unit) is formed by the rollers. In the secondary transferring unit, the monochromic or full-colored toner image formed on the transferring belt 40 is transferred onto a transcription material, such as a sheet, a film, or a fabric, which is transported in a transcription material-transporting path L. Further, a fixing unit (not shown) is disposed at a downstream side in the sheet transporting path L and fixes the monochromic toner image or full-colored toner image on the transcription material by applying heat.

The transcription material is supplied to the secondary transferring unit by a sheet feeder (not shown). The transcription material set in the sheet feeder is sent out to the transcription material-transporting path L one by one at predetermined timings. In the transcription material-transporting path L, the transcription material is transported to the secondary transferring unit by gate rollers 101 and 101' and the monochromic or full-colored toner image formed on the transferring belt 40 is transferred onto the transcription material.

The tension roller 42 holds an intermediate transcriptional body 40 together with the driving roller 41 and a cleaning blade 46 that cleans the transferring belt 40 are disposed in contact with the position where the intermediate transcriptional body 40 is held on the tension roller 42.

Figure 2:
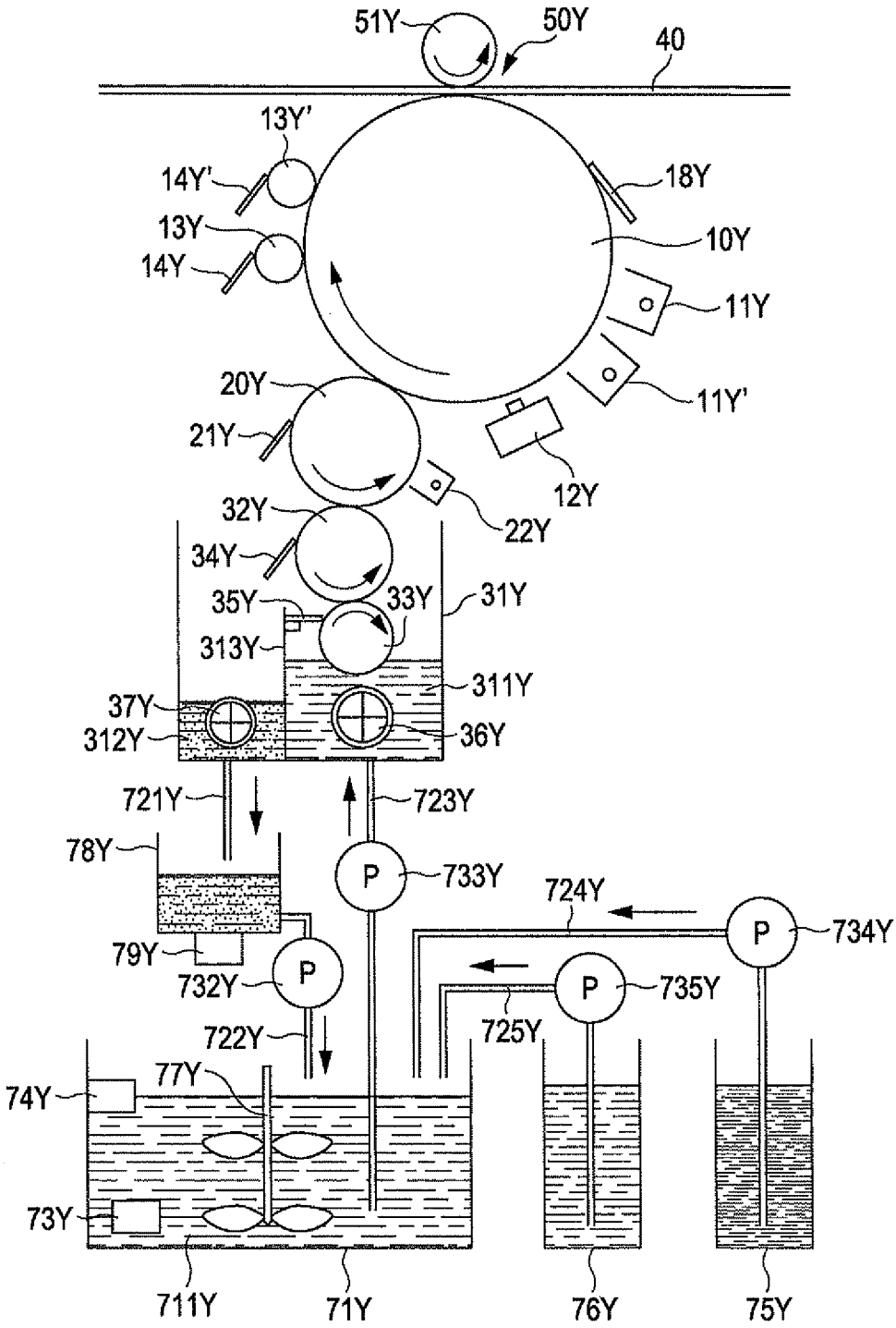
FIG. 2 is a cross-sectional view showing the main configurations of an image forming unit, a developing unit, and a developer supply unit.

In the image forming apparatus, the image forming units for respective colors and a developer supply that supplies the liquid developer to the developing units are described. FIG. 2 is a cross-sectional view showing the main configurations of an image forming unit, a developing unit, and a developer supply unit according to an embodiment of the invention and FIG. 3 is a side view of the image forming unit and the developing unit and a cross-sectional view of the developer supply unit, according to an embodiment of the invention.

As shown in FIG. 2, the liquid developer storage 311Y storing the liquid developer supplied to the developing roller 20Y and the collected-liquid storage 312Y storing the collected liquid developer are disposed in the developing container 31Y in the developing unit 30Y. Further, the liquid developer storage 311Y and the collected-liquid storage 312Y are separated by a separating plate 313Y.

Figure 3:
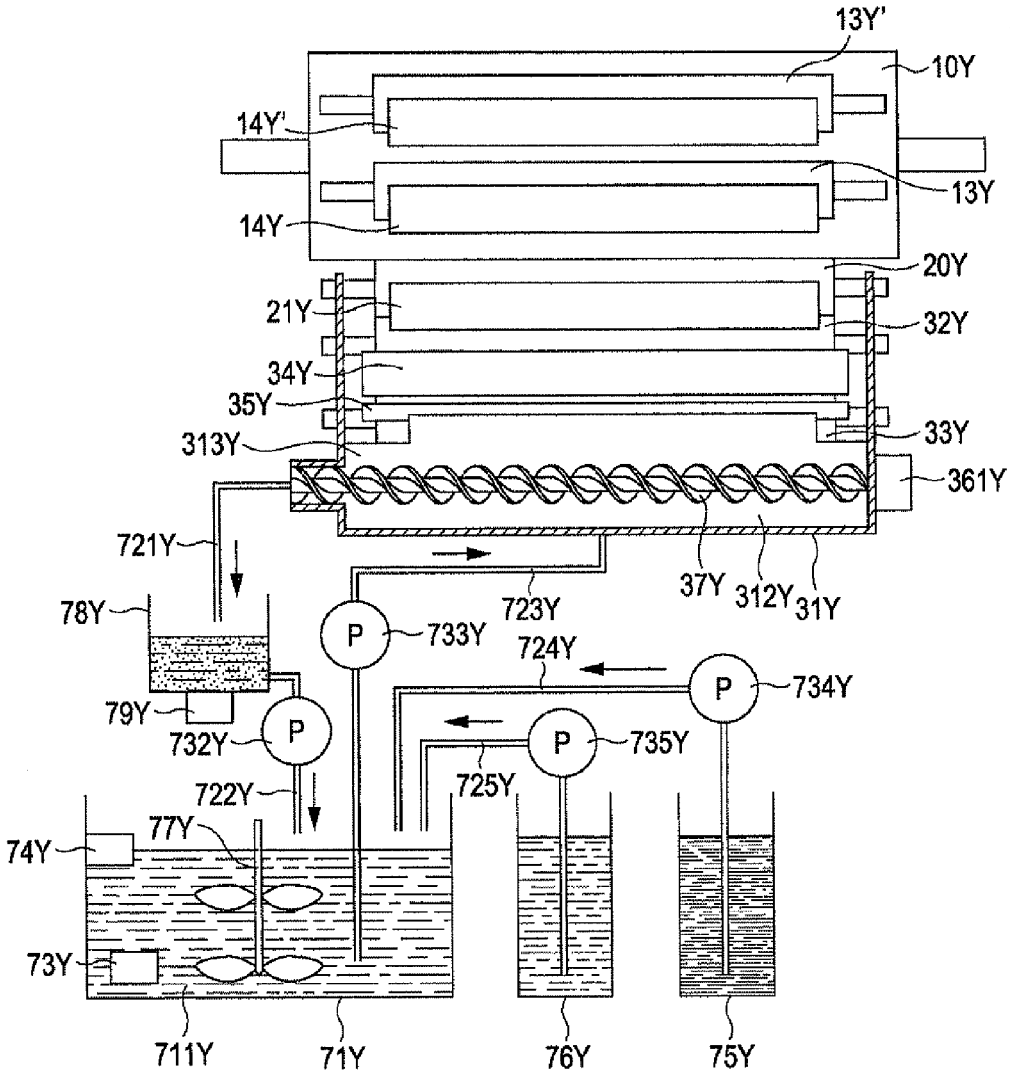
FIG. 3 is a side view of the image forming unit and the developing unit and a cross-sectional view of the developer supply unit.

A side view of the developing unit 30Y seen from the collected-liquid storage 312Y is shown in FIG. 3. As shown in the figure, the separating plate 313Y has both ends that are partially notched, such that the heights of both ends are reduced. The liquid level keeps constant in the developer storage 311Y by allowing the liquid developer to overflow from the liquid developer storage 311Y to the collected-liquid storage, at the notched portion, such that it is possible to stably supply the liquid developer to the anilox roller 33Y. Further, the developer collected in the collected-liquid storage 312Y does not flow into the developer storage 311Y and the adjusted concentration of the liquid developer in the developer storage 311Y is not changed.

As described above, the liquid developer scraped by the blades including the developer roller cleaning roller 21Y, in addition to the liquid developer overflowing from the developer storage 311Y, is stored in the collected-liquid storage 312Y. In particular, the liquid collected from the developing roller 20Y receives an electric field from the toner charging unit 22Y and is compressed between the developing roller 20Y and the photoreceptor 10Y, such that a lot of the aggregation substance of toner particles is contained.

The collected liquid stored in the collected-liquid storage 312Y is supplied again to the developer storage 311Y for reuse after the concentration is adjusted in the developer supply unit. As described above, the configuration of the developer supply unit for reusing the liquid developer is described.

The embodiment is provided with a high-concentration developer tank 76Y, a carriage liquid tank 75Y, a concentration adjustment tank 71Y, a first transporting mechanism connecting the collected-liquid storage 312Y with the concentration adjustment tank 71Y, and a second transporting mechanism connecting the concentration adjustment tank 71Y with the developer storage 311Y, as the main configuration of the developer supply unit.

The concentration adjustment tank 71Y includes a supply developer storage 711Y that stores the liquid developer and adjusts the concentration. It is possible to supply a high-concentration developer through a transporting path 725Y from the high-concentration developer tank 76Y and the carrier liquid through a transporting path 724Y from a carrier liquid tank 75, into the supply developer storage 711Y. Although the developer is actively supplied by disposing pumps 735Y and 734Y in the transporting paths 725Y and 724Y, respectively, in the embodiment, valves may be employed instead of the pumps such that the developer is supplied by self weight, when fluidity is high.

A concentration sensor 73Y that senses toner concentration in the liquid developer, a liquid level sensor 74Y that senses the amount of liquid, and a stirring member 77Y that stirs the stored liquid developer are disposed in the supply developer storage 711Y. The concentration sensor 73Y can adjust the concentration (solid concentration 25%) and the amount of the liquid developer stored in the supply developer storage 711Y at a constant level by stirring the developer with the stirring member 77Y, by driving the pumps 735Y and 734Y, on the basis of output from the liquid level sensor 74Y.

The liquid developer of which the concentration is adjusted is used to form the image transported to the developer storage 311Y of the developing unit 30Y through the second transporting mechanism. The second transporting mechanism is composed of a transporting path 723Y and a pump 733Y in the embodiment.

Meanwhile, in the embodiment, the first transporting mechanism that transports the collected liquid to the supply developer storage 711Y from the collected-liquid storage 312Y includes a transporting path 721Y, a distribution container 78Y, an ultrasonic vibrator 79Y, a transporting path 722Y, and a pump 732Y, which are main components.

The collected liquid in the collected-liquid storage 312Y is actively discharged by a collecting auger 37Y and temporarily stored in the distribution container 78Y through the transporting path 721Y. For example, the collecting auger 37Y is a member having a screw on a rotary shaft and allows transportation of the collected liquid by being rotated by a collecting auger driving unit 361Y. In the embodiment, as shown in FIG. 3, the collected liquid in the collected-liquid storage 312Y is transported left and right to the transporting path 721Y.

The collected liquid that reached the transporting path 721Y drops into the distribution container 78Y by self weight. The distribution container 78Y distributes the collected liquid, that is, allows efficient prevention of aggregation of toner particles, by temporarily storing the collected liquid.

The ultrasonic vibrator 79Y (oscillating member) is disposed in the distribution container 78Y and the collected liquid (liquid developer) can be distributed by cavitation generated by vibration of the ultrasonic vibrator 79Y.

The transporting path 722Y including the pump 732Y is connected to the distribution container 78Y and transports the collected liquid in the distribution container 78Y to the supply developer storage 711Y. It is possible to adjust the amount of collected water in the distribution container 78Y by adjusting the transportation amount of the pump 732Y. In this case, a liquid level sensor is disposed to detect the amount of liquid in the distribution container 78Y.

The configuration of the developer supply unit was described above with reference to FIGS. 2 and 3, but the liquid developer can be adjusted in concentration and reused by the supply of liquid developer described above. In particular, in the embodiment, when the collected liquid is transported from the collected-liquid storage 312Y to the supply developer storage 711Y, vibration is applied by the ultrasonic vibrator 79Y, such that the collected liquid containing aggregation substances can be distributed. Further, although vibration is applied, with the collected liquid temporarily stored, by disposing the distribution container 78Y in the first path in the embodiment, the vibration may be applied in various ways as long as it is in the first path.

Figure 4:
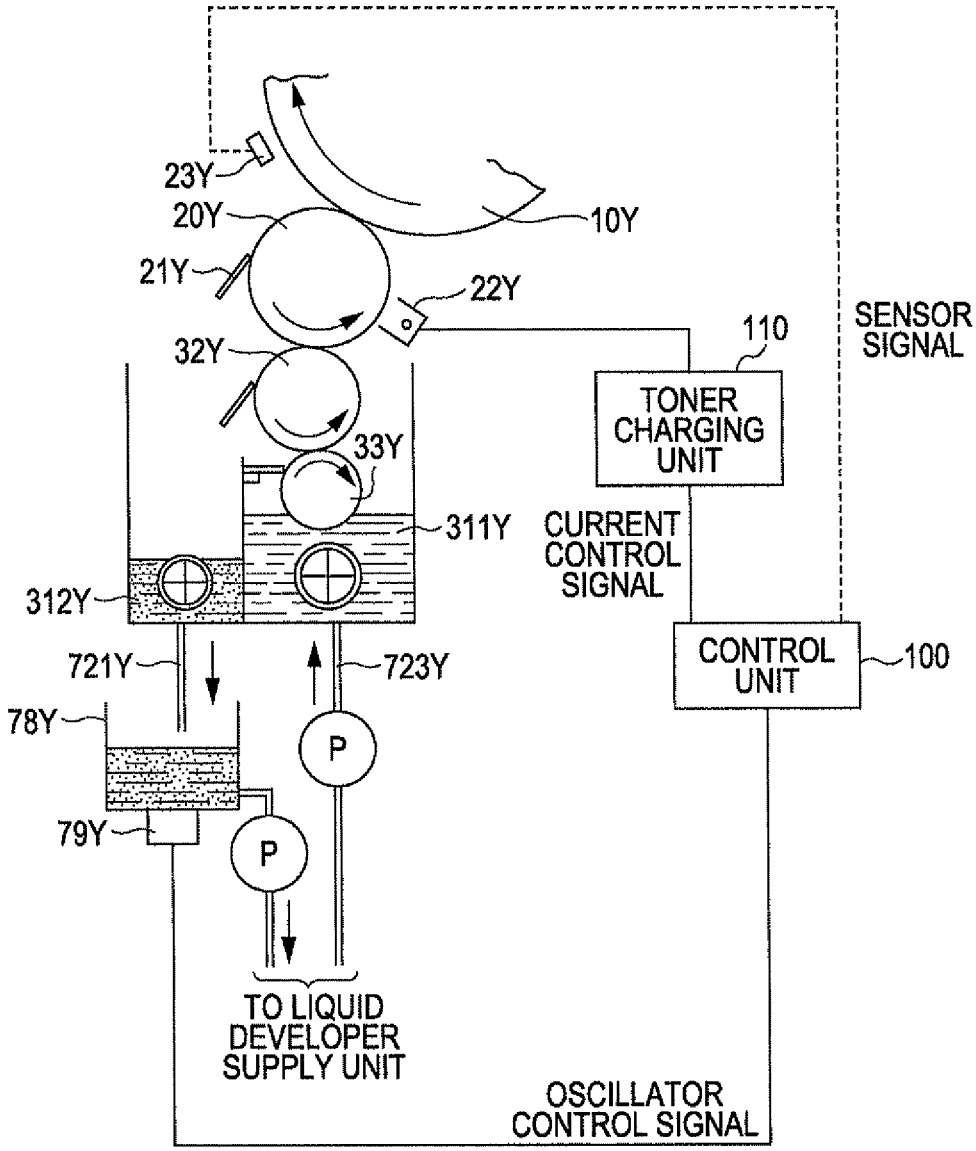
FIG. 4 is a view showing a control configuration of an image forming apparatus according to an embodiment of the invention.

FIG. 4 is a view showing a control configuration of an image forming apparatus according to an embodiment of the invention. In the image forming apparatus, a charge state of the liquid developer on the developing roller 20Y is adjusted by controlling the value of a current flowing to the toner charging unit 22Y in order to reduce non-uniformity of an image. It is possible to reduce non-uniformity of an image by increasing the charge amount of the liquid developer, whereas aggregation of the collected liquid that is collected by the developing roller 20Y is accelerated. In the embodiment, the vibration of the ultrasonic vibrator 79Y is controlled on the basis of the bias applied to the toner charging unit 22Y in consideration of the aggregation characteristic of the collected liquid.

Figure 5:
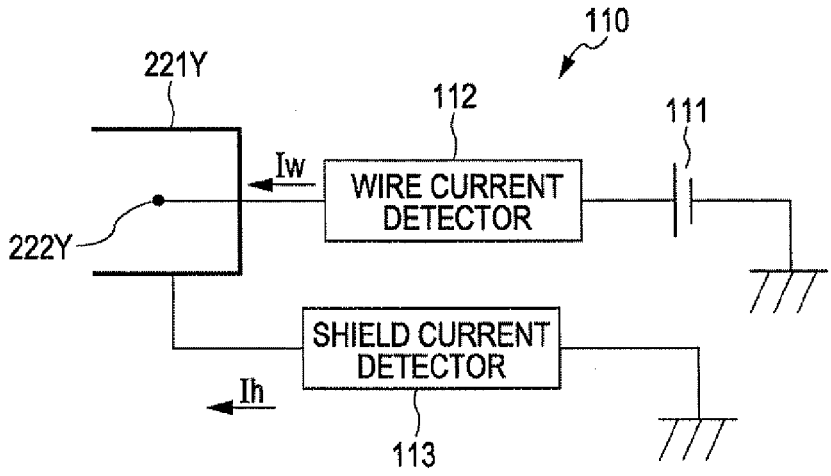
FIG. 5 is a view showing the configuration of a toner charging unit and a toner charging unit-control unit according to an embodiment of the invention.

FIG. 5 is a view showing a control configuration of the toner charging unit 22Y according to an embodiment of the invention. The configuration of the toner charging unit 22Y is shown in the cross-sectional direction taken in the same direction as FIG. 2. As the toner charging unit 22Y of the embodiment, a corotron charging unit equipped with a shield 221Y having an opening at a discharge side, and a wire 222Y is used. The shield 221Y and the wire 222Y extend in the rotational direction of the developing roller 20Y to be discharged, and charges the liquid developer applied on the developing roller 20Y on the basis of the current applied to the toner charging unit controller 110.

The toner charging unit controller 110 includes a toner charge power supply 111, a wire current detector 112, and a shield current detector 113. Bias is applied to the wire 222Y by the toner charge power supply 111. The value Iw of the current flowing to the wire 222Y is detected by the wire current detector 112 and the value Ih of the current flowing to the shield 221Y is detected by the shield current detector 113. The effective current that contributes to charging the liquid developer (hereafter, referred to as "toner charge current") is given as the difference in the values of the currents (Iw−Ih). The toner charge current is adjusted to be a desired toner charge current by adjusting the bias of the toner charge power supply 111. Further, the toner charging unit controller 110 of the embodiment grounds the shield 221Y, but may also apply bias to the shield 221Y.

The control unit 100 controls toner charge current of the toner charging unit 22Y by outputting a current control signal to the toner charging unit controller 110. The current control signal is changed, for example, by detecting the optical concentration of the toner image formed on the photoreceptor 10Y with the optical sensor 23Y disposed around the photoreceptor 10Y. In this case, it is preferable to use a test image for the toner image, in which a test image is formed on the photoreceptor 10Y and the current control signal is changed in accordance with the sensor signal output by detecting the test image with the optical sensor 23Y. Further, the toner image is detected not only on the photoreceptor 10Y and may be detected on the transferring belt 40.

Further, the electric field applied to the toner charging unit 22Y may be changed not only by the optical concentration of the toner image, but also the state of the liquid developer that contributes to forming the image. For example, the concentration and temperature of the liquid developer stored in the developer storage 311Y may be considered.

The power for oscillating the ultrasonic vibrator 79Y is controlled on the basis of an vibrator control signal sent from the control unit 100. In the embodiment, it is possible to apply vibration in accordance with the aggregation state of the collected liquid from the ultrasonic vibrator 79Y by changing the vibrator control signal, in accordance with the change in the current control signal. Further, it is possible to control viscosity of the liquid developer within a predetermined range without increasing the temperature of the circulating liquid developer by applying vibration in accordance with the aggregation state of the collected liquid, such that it is possible to form a favorable image.

Figure 6:
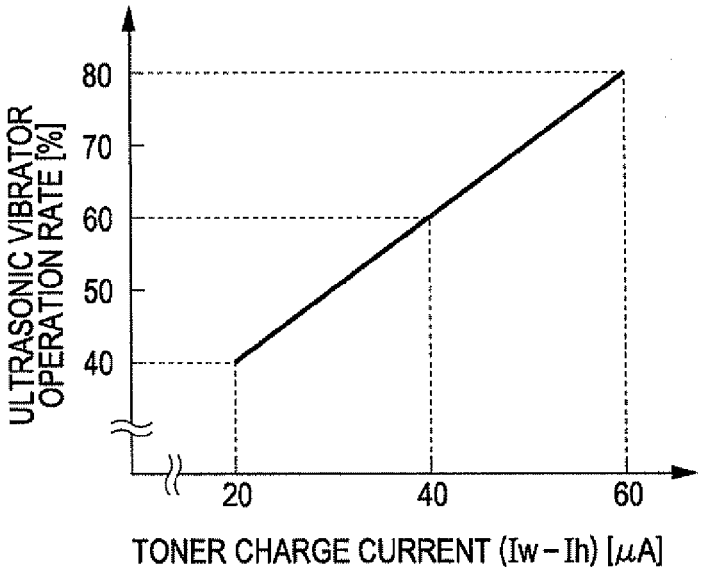
FIG. 6 is a view showing the relationship between a toner charge current and vibrator operation rate, according to an embodiment of the invention.

FIG. 6 is a view showing the relationship between a toner charge current and ultrasonic vibrator operation rate, according to an embodiment of the invention. In the embodiment, the toner charge current of the toner charging unit 22Y has a standard value at 40 μA and is controlled within the range of ±20 μA from the standard value (20 to 60 μA).

The operation rate of the ultrasonic vibrator 79Y is controlled in the range of 40 to 80% in accordance with the toner charge current of the toner charging unit 22Y. The toner charge current and the operation rate are linearly proportionately controlled, but may be non-linearly controlled or may be controlled by various formulae in consideration of the properties of the liquid developer.

Figure 7A:
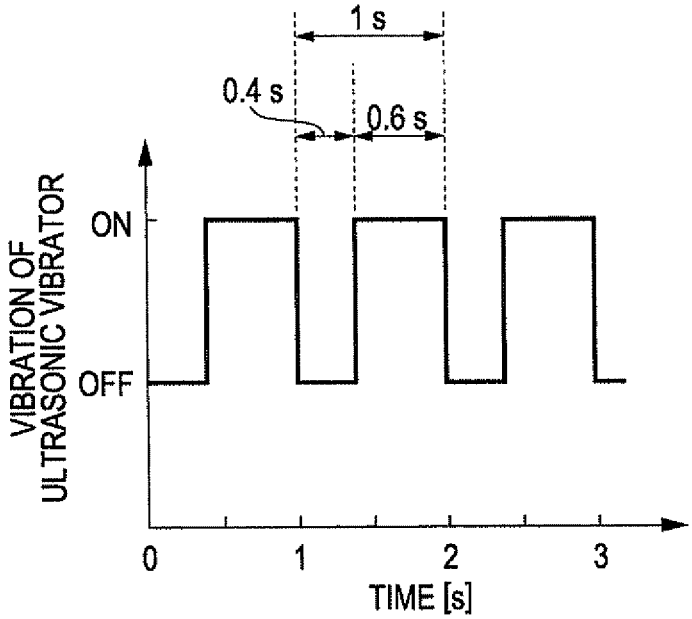
FIGS. 7A and 7B are views showing the operation of an ultrasonic vibrator according to an embodiment of the invention.
Figure 7B:
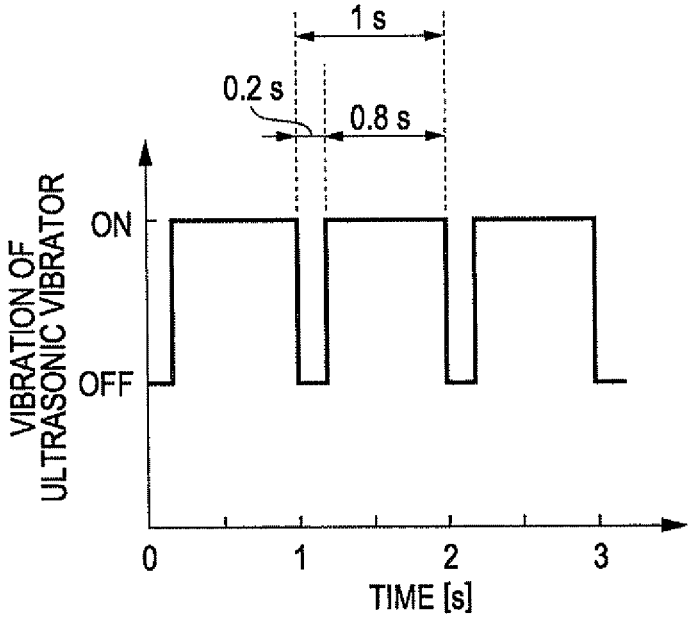

FIGS. 7A and 7B are views illustrating the operation rate of the ultrasonic vibrator 79Y according to an embodiment of the invention. FIG. 7A shows an vibration cycle of the ultrasonic vibrator 79Y, in which an vibration period of 0.6 seconds and an vibration stop period of 0.4 seconds are alternately given, thereby implementing an operation rate of 60%. On the other hand, in FIG. 7B, an vibration period of 0.8 seconds and an vibration stop period of 0.2 seconds are alternately given, thereby implementing an operation rate of 80%. Further, it is possible to adjust the operation rate with desired power of vibration by appropriately adjusting the vibration period and the vibration stop period.

Figure 8:
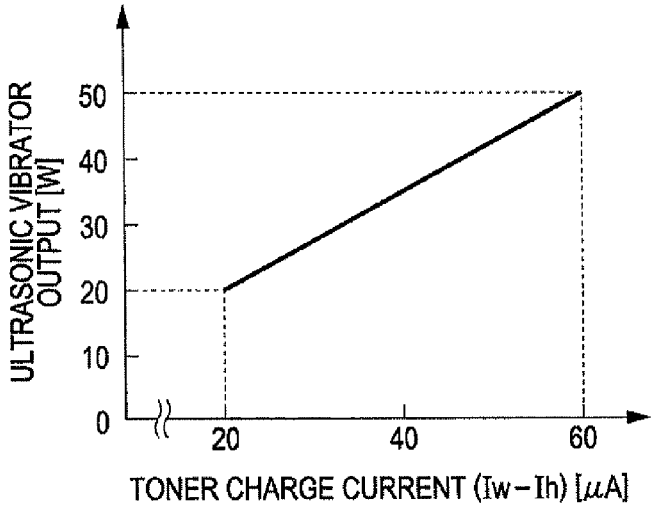
FIG. 8 is a view showing the relationship between a toner charge current and vibrator output, according to an embodiment of the invention.

In the embodiment, although the power of vibration applied to the collected liquid is controlled by controlling the operation rate of the ultrasonic vibrator 79Y, it is possible to control the power of vibration in various ways, for example, by changing the amplitude value and the ultrasonic frequency of the applied vibration. FIG. 8 is a view showing the relationship between the output (power) of the ultrasonic vibrator 79Y and the toner charge current. The output of the ultrasonic vibrator 79Y is adjusted by changing the amplitude or the frequency of a sound wave. In the embodiment, the output of the ultrasonic vibrator 79Y is 20 W at a toner charge current of 20 μA and the output is SOW at 60 μA, and the same output is achieved when the operation rate illustrated in FIG. 6 is controlled.

Figure 9:
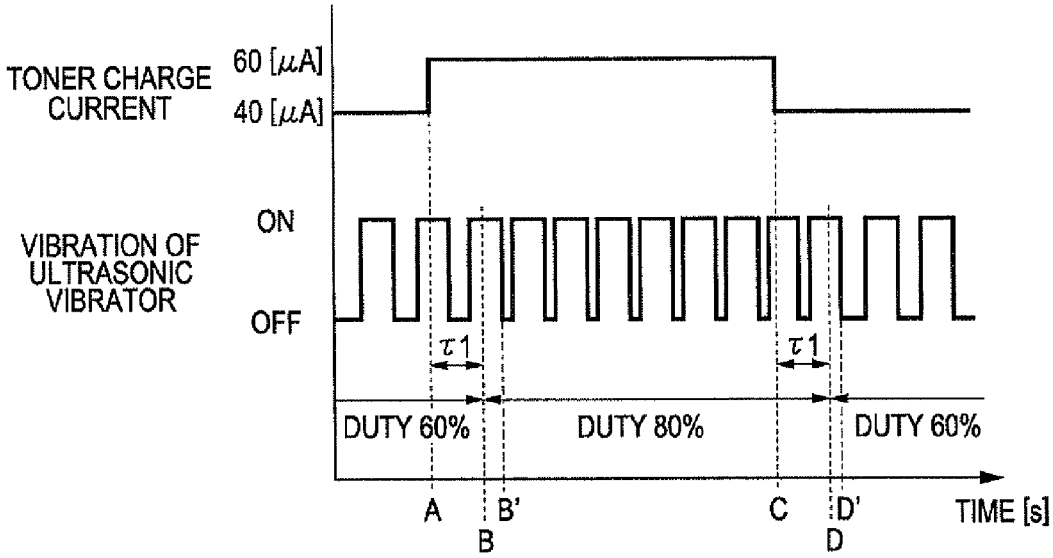
FIG. 9 is a view showing control of an image forming apparatus according to an embodiment of the invention.

FIG. 9 is a view showing control of an image control device (time chart) according to an embodiment of the invention. In the initial state, the toner charge current is set at 40 μA and the operation rate of the ultrasonic vibrator 79Y is set at 60%. When the toner charge current increases from 40 μA to 60 μA under the conditions of the image concentration detected by the optical sensor 23Y and the like, the operation rate (duty) of the ultrasonic vibrator 79Y is increased to 80%.

In the embodiment, the time difference τ1 (time lag) in control from changing the toner charge current to changing the operation rate is set in consideration of the transport time from until the collected liquid of which the degree of aggregation is increased by the increase in toner charge current is stored in the distribution container 78Y through the developing roller cleaning blade 21Y, the collected-liquid storage 312Y, and the transporting path 721Y from the toner charging unit 20Y. It is possible to accurately apply vibration to the collected liquid with the degree of aggregation increase, by giving the time difference in control.

The operation rate is changed to 80% at the time B after the time difference τ1 has passed from the time A where the toner charge current is increased in the time chart. In practice, it is difficult to change the operation rate, for the sake of expedience of the control, in the vibration period and the vibration stop period, such that the operation rate is changed at the time B' that is the next vibration stop period. Meanwhile, when the toner charge current decreases from 60 μA to 40 μA at the time C, the operation rate is changed to 60% at the time D after the time difference τ1 has passed from the time C. The operation rate is also changed from the time D' that is the next vibration stop period.

In the above, according to the embodiment, it is possible to suppress aggregation of toner when the toner charge current increases by controlling the operation rate of the ultrasonic vibrator 79Y on the basis of the value of the current flowing to the toner charging unit 22Y, and it is possible to suppress an increase in temperature of the developer while suppressing the power consumption by decreasing the operation rate of the ultrasonic vibrator when the toner charge current decreases.

Figure 10:
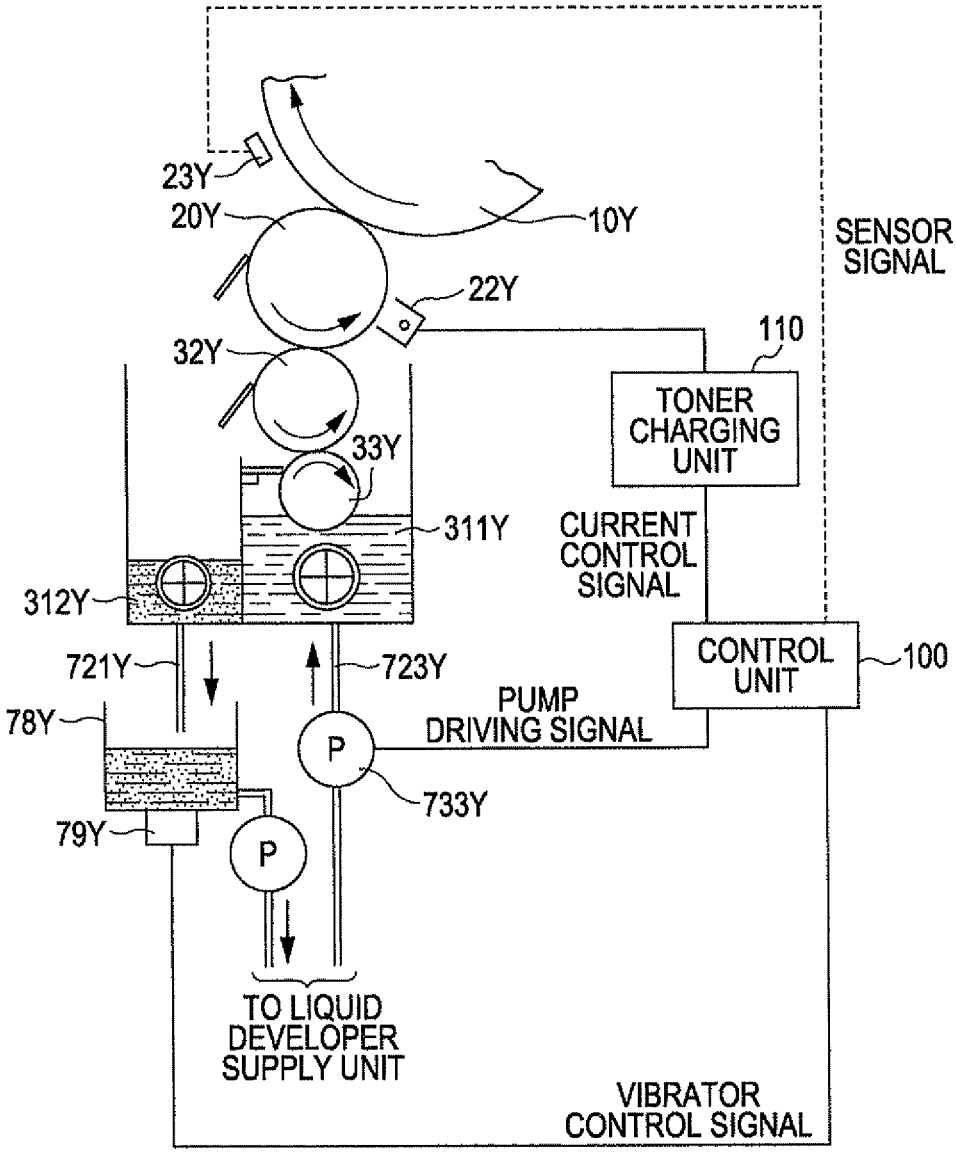
FIG. 10 is a view showing a control configuration of an image forming apparatus according to another embodiment.
Figure 11:
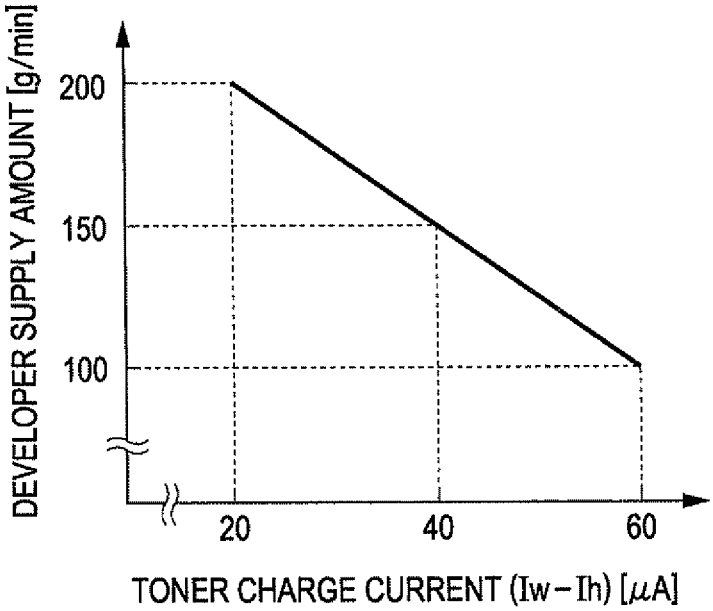
FIG. 11 is a view showing the relationship between a toner charge current and developer supply amount, according to another embodiment.
Figure 13:
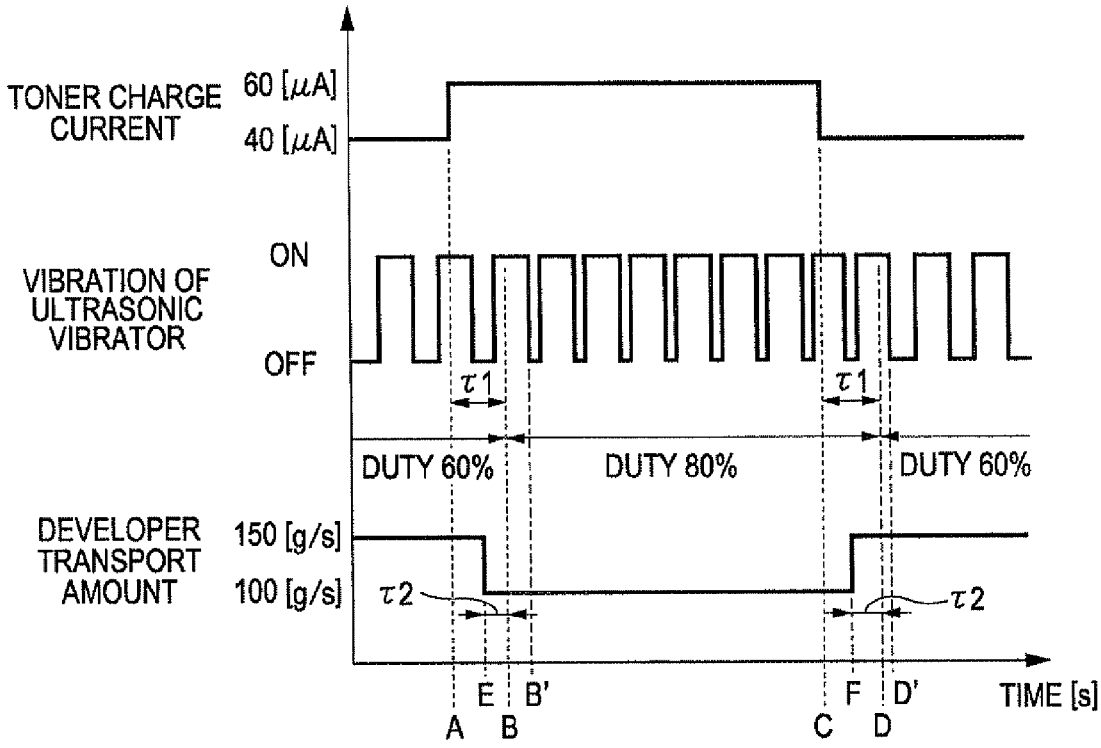
FIG. 13 is a view showing control of an image forming apparatus according to another embodiment.

Next, a second embodiment of controlling the image forming apparatus is described with reference to FIGS. 10 to 13. FIG. 10 is a view showing a control configuration of an image forming apparatus according to the second embodiment of the invention, FIG. 11 is a view showing the relationship between a toner charge current and developer supply amount, according to the second embodiment of the invention, and FIG. 12 is a view showing the amount of a developer at each unit according to the second embodiment of the invention. FIG. 13 is a view showing control of the image forming apparatus according to the second embodiment of the invention.

In the second embodiment, the amount of the liquid developer transported from the liquid developer supply unit to the developer storage 311Y is controlled by the ultrasonic vibrator 79Y in order to effectively prevent aggregation of the toner.

As can be seen from the control configuration of FIG. 10, the control unit 100 controls the pump 733Y that transports the liquid developer from the liquid developer supply unit to the developer storage 311Y, in addition to the control configuration illustrated in FIG. 4. When the toner charge current is large and a large amount of toner is aggregated, the amount of developer supplied to the developer storage 311Y is decreased, thereby reducing the storage amount of the distribution container 78Y and increasing the distribution effect by the ultrasonic vibrator 79Y. On the other hand, when the toner charge current is small, a small amount of toner is aggregated, such that the storage amount of the distribution container 78Y is increased and an increase in temperature of the developer is suppressed.

FIG. 11 is a view showing an example of the relationship between the toner charge current and the amount of developer transported to the developer storage 311Y, When the toner charger is controlled in the range of 20 μA to 60 μA, the supply amount of developer is linearly controlled from 100 to 200 g/min. Further, in this case, the control is nonlinearly performed or performed by various formulae, in consideration of the properties of the liquid developer.

FIG. 12 shows an example of the amount of a developer when the amount of transported developer is controlled. The example is when the development amount is constant, in which the storage amount of the distribution container 78Y is 147 g at a normal toner charge current 40 μA, while the storage amount is large, 197 g, at the toner charge current of 20 μA, and small, 97 g, at the toner charge current of 60 μA. As described above, when the toner charge current is large and the liquid developer is easily aggregated, the storage amount of the distribution container 78Y is reduced such that the distribution effect by the ultrasonic vibrator 79Y is increased, and when the toner charge current is small, the storage amount of the distribution container 78Y is increased and an increase in temperature of the developer is suppressed by decreasing the aggregated toner.

FIG. 13 is a view showing control of an image control device (time chart) according to the second embodiment. Since the control of the operation rate of the ultrasonic vibrator 79Y according to the toner charge current is the same as the control illustrated in FIG. 9, control of the transport amount of the liquid developer according to the toner charge current is described in the example.

In the initial state, the toner charge current is set at 40 μA and the amount of the developer transported by the pump 733Y is set at 150 g/s. When the toner charge current increases from 40 μA to 60 μA under the conditions of the image concentration detected by the optical sensor 23Y and the like, the transport amount is decreased to 100 g/s.

As can be seen from FIG. 12, a change in storage amount of the distribution container 78 due to a change in developer supply amount, that is, most of the overflow amount, as shown in FIGS. 2 and 3, is the overflow amount of the developer overflowing the collected-water storage 312Y through the separating plate 313Y from the developer storage 311Y. Therefore, the embodiment is implemented in consideration of the time until the transport amount of the developer which is changed by the pump 733Y influences the storage amount of the distribution container 78Y, that is, the time until the developer overflows the separating plate 313Y from the developer storage 311Y and is stored into the distribution container 78Y through the collected-liquid storage 312Y and the transporting path 721Y.

In detail, the transport amount of the developer is reduced to 100 g/s from the time E, a predetermined time τ2 earlier from the time B where the operation rate of the ultrasonic vibrator 79Y is changed. The time difference τ2 is exactly the time until the transport amount of the developer, which is changed by the pump 733Y, influences the storage amount of the distribution container 78Y, such that it is possible to effectively distribute the developer by changing the operation rate when the storage amount of the distribution container 78Y is changed. When the time differences τ1 and τ2 are fixed, the transport amount of the developer is changed after a predetermined time τ1−τ2 has passed from the time where the toner charge current is changed.

On the other hand, when the toner charge current is decreased from 60 μA to 40 μA at time C, the transport amount of the developer is increased to 150 g/s at the time F, the time difference τ2 earlier from the time D where the operation rate of the ultrasonic vibrator 79Y is changed. In this case, it is possible to apply vibration to the collected liquid in the distribution container 78Y of which the storage amount is reduced, with the operation rate of the ultrasonic vibrator 79Y increased, such that it is possible to prevent an increase in temperature of the circulating liquid developer.

In the embodiment described above, as the amount of the liquid developer transported to the developer storage 311Y is controlled, in addition to a change in operation rate of the ultrasonic vibrator 79Y according to the toner charge current, it is possible to store an appropriate amount of collected liquid in the distribution container 78Y and effectively distribute the collected liquid.

According to the invention described above, as the vibration applied to the ultrasonic vibrator 79 (oscillating member) is controlled in accordance with the toner charge current flowing to the toner charging unit 22 (corotron charging unit), it is possible to effectively prevent aggregation of the toner and supply an image with high quality.

Figure 14:
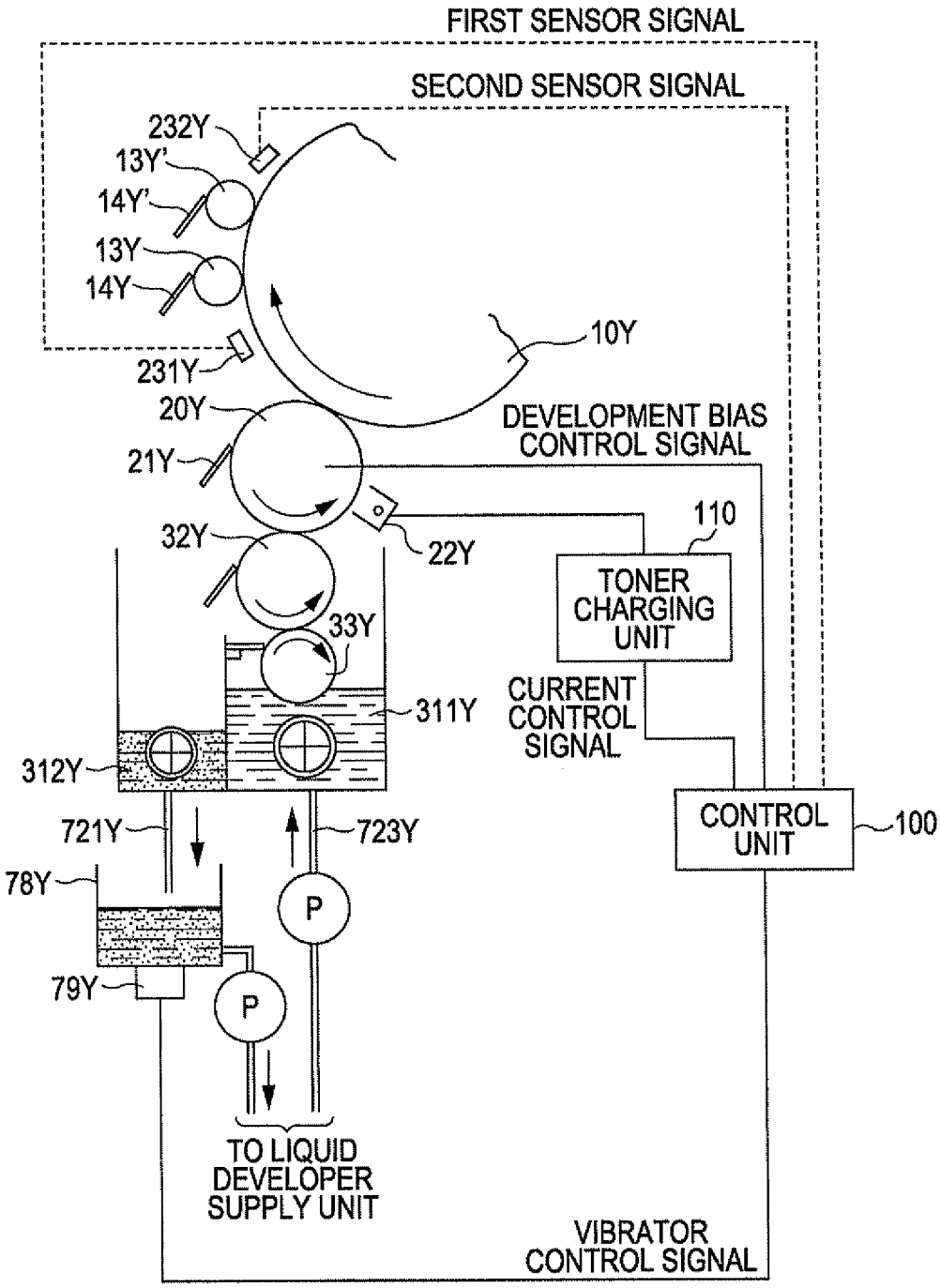
FIG. 14 is a view showing a control configuration of an image forming apparatus according to another embodiment.

FIG. 14 is a view showing a control configuration of an image forming apparatus according to another embodiment of the invention. The optical concentration (sensor signal) of the toner image on the photoreceptor 10Y is detected by the optical sensor 23Y and the toner charge current flowing to the toner charging unit 22Y is controlled on the basis of the optical concentration in the embodiments illustrated in FIGS. 4 and 10, whereas the magnitude of the toner charge current is controlled in accordance with the magnitude of the development bias applied to the developing roller 20Y in this embodiment. Further, in this embodiment, the development bias is adjusted in accordance with the output of the first optical sensor 231Y and the second optical sensor 232Y, which are disposed ahead of and behind the development squeeze device.

The development bias applied to the developing roller 20Y may be adjusted in order to adjust the concentration of an image to be formed or suppress fog toner. When the development bias is set low, inverse contrast potential is increased, such that an intensive current field is generated in the non-image portion on the developing roller 20Y and the solid component in the toner is compressed on the developing roller 20Y, thereby accelerating aggregation of the toner. The toner in the non-image portion on the developing roller 20Y is collected by the developing roller cleaning blade 21Y, but the aggregated toner increases, such that clogging of the anilox roller 33Y is accelerated, which causes a defect in the image. Therefore, the toner charge current is controlled in accordance with the set value of the development bias in the embodiment.

Figure 15:
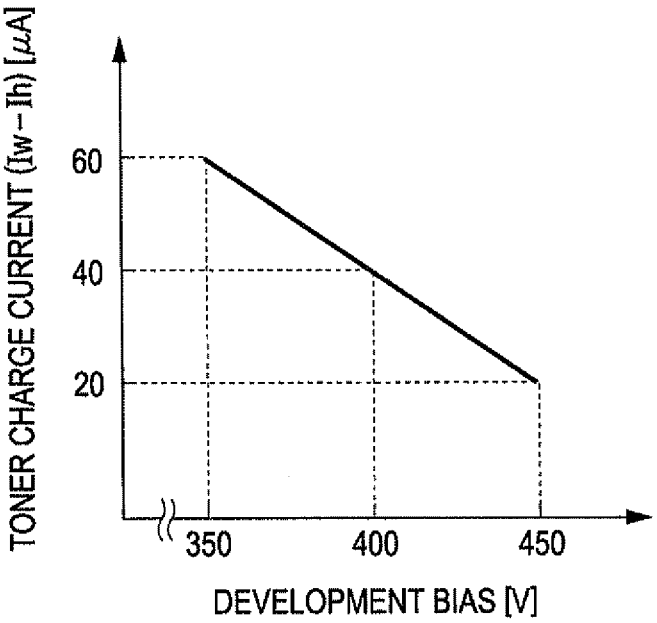
FIG. 15 is a view showing the relationship between development bias and a toner charge current, according to another embodiment.

FIG. 15 is a view showing the relationship between development bias and a toner charge current, according to the embodiment. The development bias is controlled from 350V to 450V, in which the standard value is 400V. Further, the toner charge current is controlled within the range of 20 μA to 60 μA. The development bias is reduced to decrease the image concentration or suppress fog toner. In this case, fog toner is suppressed from being generated by increasing the toner charge current such that toner particles in the liquid developer are pressed against the developing roller 20. Meanwhile, the development bias is increased to increase the image concentration. In this case, the toner charge current is decreased.

The development bias is adjusted to a predetermined bias value by a development bias control signal output from the control unit 100. The development bias control signal is input to a bias applying unit (not shown) and the development bias is applied to the developing roller 20Y by the bias applying unit.

Further, in the embodiment, the first optical sensor 231Y and the second optical sensor 232Y are disposed ahead of and behind the squeeze device to detect the generation state of fog toner. The generation state (degree) of fog toner is detected by forming a test image with a predetermined toner concentration onto the photoreceptor 10Y and detecting a change in concentration with the first optical sensor 231Y and the second optical sensor 232Y. The generation state of fog toner is detected and the development bias is adjusted in accordance with the state of the fog toner, on the basis of a first sensor signal and a second sensor signal from the optical sensors 231Y and 232Y, respectively, in the control unit 100. In the embodiment, the toner charge current is adjusted in accordance with the adjustment of the development bias and the vibration applied to the liquid developer by the ultrasonic vibrator 79Y is adjusted.

In the embodiment described above, the toner charge current flowing to the toner charging unit 22Y is changed in accordance with the development bias applied to the developing roller 20Y, the toner charge current may be adjusted in accordance with various states of the image forming apparatus or various settings.

Further, although various embodiments are described herein, other embodiments implemented by appropriately combining the configurations of the embodiments are included in the scope of the invention.

The entire disclosure of Japanese Patent Application No. 2011-021456, filed Feb. 3, 2011 is expressly incorporated by reference herein.

What is claimed is:

1. An image forming apparatus comprising:

a developing unit including a liquid developer storage that stores a liquid developer containing toner and carrier liquid, a developer carrier that carries the liquid developer, a toner charging unit that charges the liquid developer receiving a toner charge current and carried on the developer carrier, and a cleaning member that collects the liquid developer by cleaning the developer carrier;

a first transporting mechanism including a first transporting path through which the liquid developer collected by the cleaning member is moved and an oscillating member that is disposed in the first transporting path and applies vibration to the liquid developer to be transported to the first transporting path, in order to transport the liquid developer;

a developer supply unit storing the liquid developer transported from the first transporting mechanism;

a second transporting mechanism including a second transporting path that transports the liquid developer stored in the developer supply unit to the developer storage of the developing unit; and a control unit adjusting the toner charge current that is applied to the toner charging unit and controlling vibration of the oscillating member on the basis of the adjusted toner charge current.

2. The image forming apparatus according to claim 1, wherein the toner charging unit is a corotron charging unit having a wire and a shield and the toner charge current is a difference between a current flowing to the wire and a current flowing to the shield.

3. The image forming apparatus according to claim 1, wherein the control unit makes the oscillating member oscillate with a first bias when the toner charge current applied to the toner charging unit is a first current value, and makes the oscillating member oscillate with a second bias larger than the first bias when the toner charge current applied to the toner charging unit is the second current value larger than the first current value.

4. The image forming apparatus according to claim 3, wherein the control unit changes power supplied to the oscillating member from first power to second power, after a predetermined time has passed, when the toner charge current applied to the toner charging unit is changed from the first current value to the second current value.

5. The image forming apparatus according to claim 3, wherein the control unit controls the amount of the liquid developer transported to the second transporting mechanism on the basis of the toner charge current applied to the toner charging unit.

6. The image forming apparatus according to claim 5, wherein the control unit allows the liquid developer transported from the second transporting mechanism to be transported at a first transport amount when the toner charge current applied to the toner charging unit is the first current value, and allows the liquid developer transported from the second transporting mechanism to be transported at a second transport amount smaller than the first transport amount when the toner charge current applied to the toner charging unit is the second current value.

7. The image forming apparatus according to claim 1, wherein the oscillating member is an ultrasonic vibrator.

8. An image forming method comprising:

carrying a liquid developer containing toner and carrier liquid, which is stored in a developer storage disposed in a developing unit, to a developer carrier;

charging the liquid developer carried on the developer carrier with a toner charging unit;

developing a latent image formed on a latent image carrier with the liquid developer charged by the toner charging unit;

cleaning the developer carrier used for developing the latent image with a cleaning member;

applying vibration with power, which is adjusted on the basis of toner charge current applied to the toner charging unit, to the liquid developer collected by the cleaning member by using an oscillating member disposed in a first transporting path, and transporting the liquid developer from the first transporting path to the developer supply unit; and transporting the liquid developer stored in the developer supply unit to the developer storage of the developing unit from a second transporting path.

* * * * *